US006607391B2

(12) United States Patent
Mendelson et al.

(10) Patent No.: US 6,607,391 B2
(45) Date of Patent: Aug. 19, 2003

(54) DETACHABLE POWER SUPPLY APPARATUS

(75) Inventors: Lewis A. Mendelson, Overland Park, KS (US); Blaise M. Wooderson, Olathe, KS (US)

(73) Assignee: Innovation IP Holding Co., Davenport, IA (US)

( * ) Notice: Subject to any disclaimer, the term of this patent is extended or adjusted under 35 U.S.C. 154(b) by 275 days.

(21) Appl. No.: 09/888,903

(22) Filed: Jun. 25, 2001

(65) Prior Publication Data

US 2002/0016088 A1 Feb. 7, 2002

Related U.S. Application Data

(63) Continuation of application No. 09/609,579, filed on Jun. 30, 2000, now Pat. No. 6,267,602, which is a continuation-in-part of application No. 09/432,849, filed on Nov. 2, 1999, now Pat. No. 6,250,931.

(51) Int. Cl.[7] ..... H01R 11/30
(52) U.S. Cl. ..... 439/39; 439/38; 219/435
(58) Field of Search ..... 439/38, 39, 40, 439/374, 680, 954; 337/394, 392, 382, 398, 383, 384; 99/337, 427; 219/441, 438, 435

(56) References Cited

U.S. PATENT DOCUMENTS

| | | | | |
|---|---|---|---|---|
| RE17,993 | E | | 3/1931 | Denison |
| 2,170,287 | A | | 8/1939 | Kinnebrew |
| 2,223,359 | A | | 12/1940 | Eisinga |
| 2,744,995 | A | * | 5/1956 | Jepson ..... 219/441 |
| 2,764,747 | A | | 9/1956 | Modrey |
| 2,830,166 | A | | 4/1958 | Loomis |
| 2,856,489 | A | | 10/1958 | Bletz |
| 2,926,230 | A | | 2/1960 | Foster |
| 2,936,359 | A | | 5/1960 | Sheahan |
| 3,019,320 | A | | 1/1962 | Braski et al. |
| 3,025,374 | A | | 3/1962 | Reingruger |
| 3,031,735 | A | * | 5/1962 | Jepson ..... 29/611 |
| 3,068,342 | A | | 12/1962 | Jepson et al. |
| 3,202,798 | A | | 8/1965 | Schauer, Jr. |
| 3,218,434 | A | | 11/1965 | Lee et al. |
| 3,363,214 | A | | 1/1968 | Wright |
| 3,681,568 | A | | 8/1972 | Schaefer |
| 3,737,623 | A | | 6/1973 | Vallone |
| 3,926,493 | A | | 12/1975 | Wakabayashi |
| 4,107,638 | A | | 8/1978 | Hollweck |
| 4,356,385 | A | | 10/1982 | Stein et al. |
| 4,400,679 | A | | 8/1983 | Snider |
| 4,633,238 | A | | 12/1986 | Goessler et al. |
| 4,647,120 | A | | 3/1987 | Karabakakis |
| 4,695,816 | A | | 9/1987 | Essig et al. |

(List continued on next page.)

FOREIGN PATENT DOCUMENTS

| | | |
|---|---|---|
| FR | 578642 | 3/1924 |
| FR | 579341 | 3/1924 |

*Primary Examiner*—Ross Gushi
(74) *Attorney, Agent, or Firm*—Gerald Kraai

(57) ABSTRACT

A detachable power supply apparatus for use with electrical appliances including removable temperature control devices includes a mounting panel on the temperature control device to which an electrical connector on a power supply cord is magnetically and electrically coupled. The mounting panel includes a ferrous contact plate attached to an outer surface thereof between a pair of conductive pins. The power supply cord includes a female electrical receptacle with a magnet subassembly attached at or near an outer surface thereof. The receptacle may be removably coupled to the mounting panel by positioning the receptacle outer surface adjacent the mounting panel contact plate. The magnet subassembly is designed to allow the receptacle to withstand a preselected tensile or pulling force and a preselected shearing or lateral force.

7 Claims, 5 Drawing Sheets

U.S. PATENT DOCUMENTS

| | | | | |
|---|---|---|---|---|
| 4,754,253 | A | | 6/1988 | Slack et al. |
| 4,764,129 | A | | 8/1988 | Jones et al. |
| 4,874,316 | A | | 10/1989 | Kamon et al. |
| 4,888,470 | A | | 12/1989 | Schreder |
| 5,420,398 | A | | 5/1995 | Petri et al. |
| 5,462,452 | A | | 10/1995 | Devine |
| 5,627,507 | A | | 5/1997 | Morbitzer et al. |
| 5,699,034 | A | | 12/1997 | Tsao |
| 5,816,825 | A | | 10/1998 | Sekimori et al. |
| 5,873,737 | A | | 2/1999 | Hashizawa et al. |
| 6,250,931 | B1 | * | 6/2001 | Mendelson ..... 439/39 |
| 6,267,602 | B1 | * | 7/2001 | Mendelson et al. ..... 439/39 |

* cited by examiner

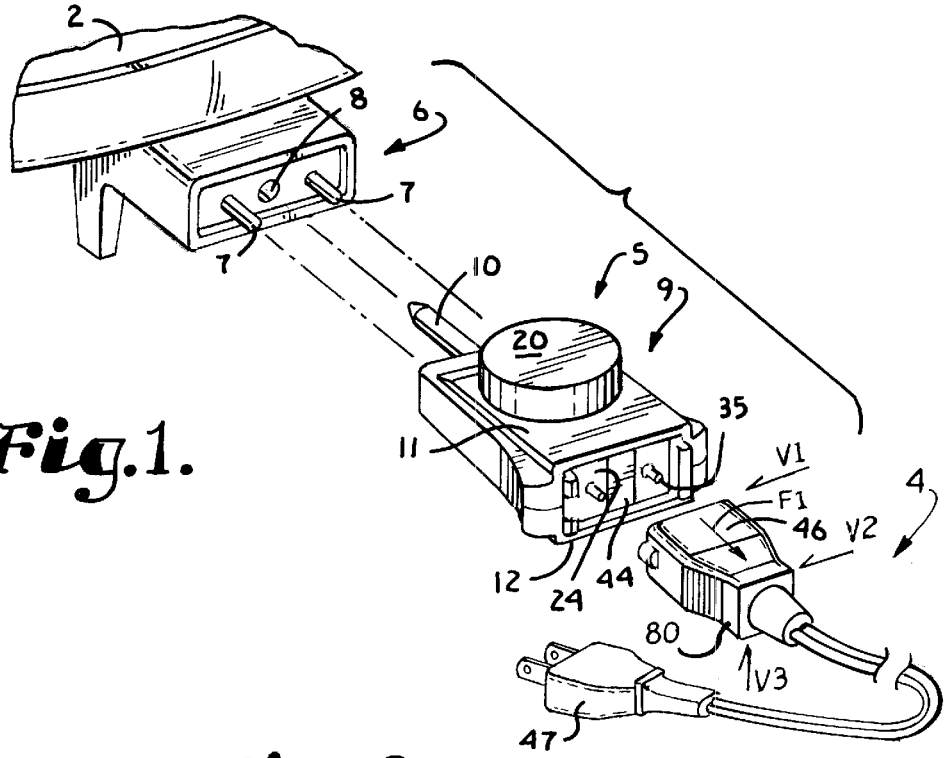
Fig.1.
Fig.2.
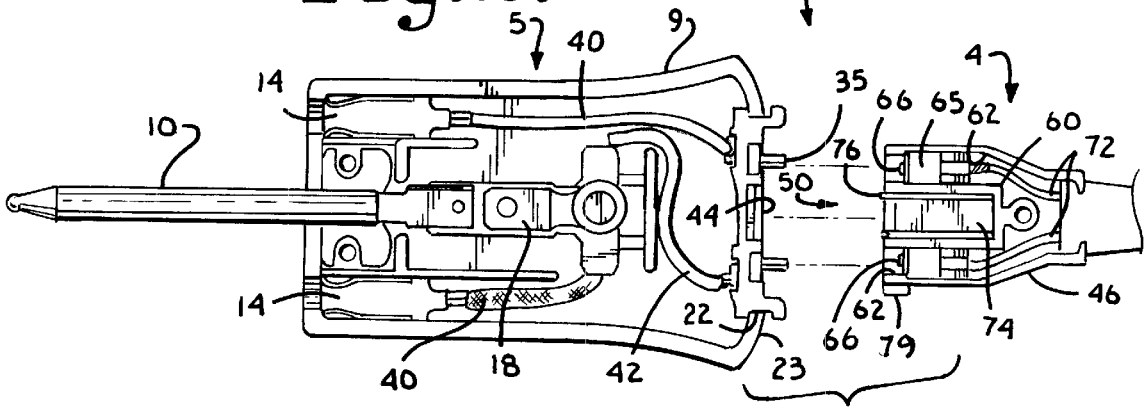

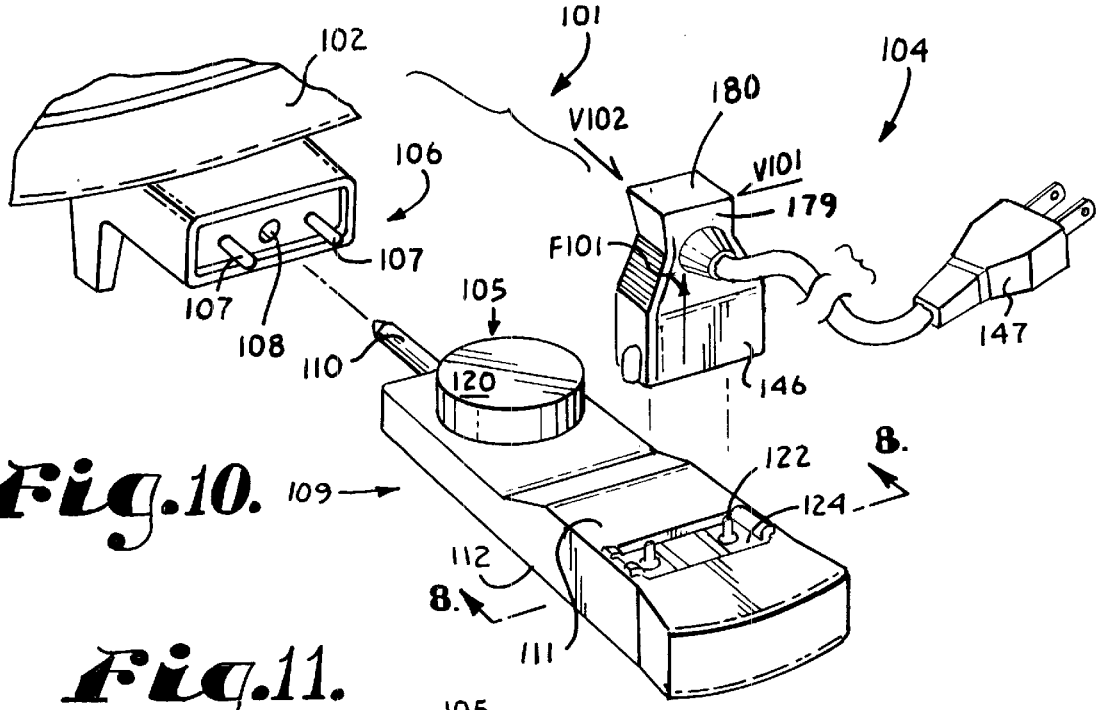
Fig.10.
Fig.11.
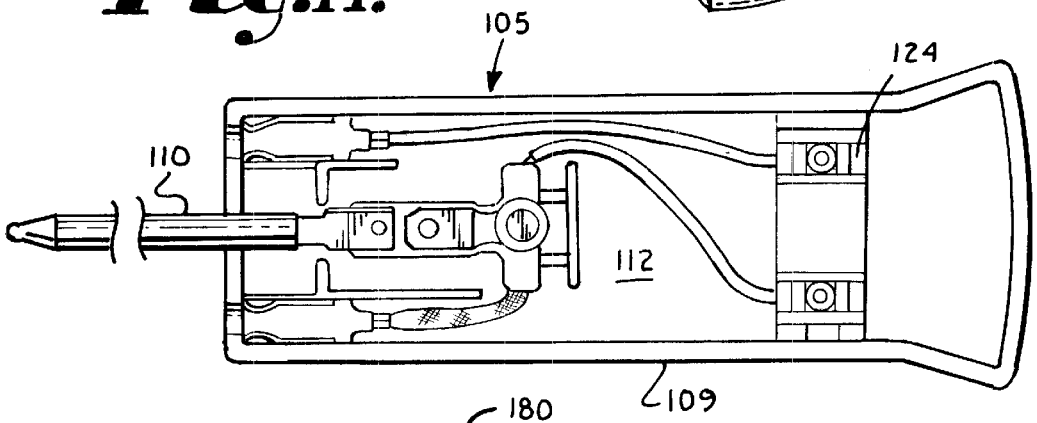
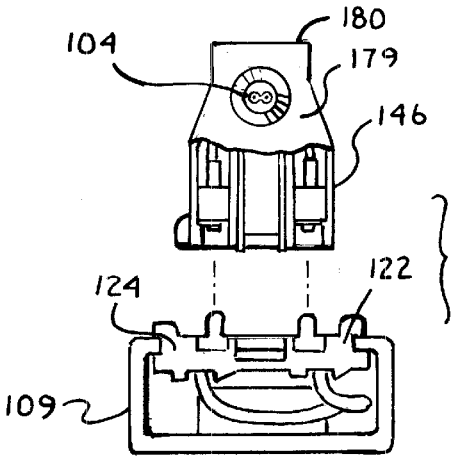
Fig.12.

DETACHABLE POWER SUPPLY APPARATUS

CROSS REFERENCE TO RELATED APPLICATION

This application is a continuation-in-part for U.S. application Ser. No. 09/432,849, entitled DETACHABLE POWER SUPPLY APPARATUS, filed Nov. 2, 1999, now U.S. Pat. No. 6,250,931.

BACKGROUND OF THE INVENTION

1. Field of the Invention

This invention is directed in general to a detachable power supply apparatus for use with temperature probes, electrical appliances such as frypans, deep fat fryers, cookers and the like, and in particular to a magnetically attachable "break-away" power supply apparatus.

2. Description of the Related Art

Detachable power supply devices are well-known. For example, detachable temperature probes with a power supply cord fixedly attached thereto have long been used with a variety of electrical appliances including cookers, fryers, skillets, fondues, woks, corn poppers and the like. Conventional detachable temperature probes typically include a central control housing with a temperature probe extending therefrom, and a power supply cord fastened to and extending from an opposite end thereof. U.S. Pat. Nos. 2,856,489, 2,926,230, and 3,019,320 all disclose detachable thermostatic control devices including a male probe which can be removably attached to an electrical appliance by insertion into a female receiver thereof. The primary advantage of such devices is the ability to separate the probe from the appliance, allowing the appliance to be fully immersed in water for cleaning.

Detachable temperature probes require that continuous, intimate contact be maintained between the male temperature probe and the appliance's female receiver to accurately control the appliance's working temperature. For example, current Underwriters Laboratories, Inc.® ("UL") STANDARDS 1083 (33.1) and (33.2) require that a detachable temperature probe attached to an appliance be capable of withstanding a separation force of 35 lbf. (156 N) at any angle for one minute.

The desire for maintaining intimate contact between an appliance and its temperature probe has compromised safety. Each year a substantial number of accidents occur, for example when a small child inadvertently trips over the probe's power cord and overturns the appliance, or when the power cord is sharply or forcefully disturbed in other ways causing the appliance to tip, overturn, or move in such a way that the contents of the appliance are spilled. Such accidents can result in serious injury, particularly when the appliance contains hot oil, boiling water, or the like. Further, studies have shown that many of these accidents occur when the probe's power cord is extended and kicked or pulled at a ninety-degree angle (90°) thereto (e.g. from the side). Of course, these accidents could be prevented or reduced if, upon being kicked, pulled or otherwise forcefully disturbed, the power cord became separated from the probe without disturbing the appliance.

Indeed, UL recently addressed this issue with respect to certain appliances in its STANDARDS 1083 (36A, effective May 30, 2001) which requires that the force required to separate the detachable power supply cord from the appliances covered by the standard shall be at least 5 percent less than the force required to overcome the static friction of the appliance on a surface.

A need thus exists to provide a safe, convenient, reliable detachable power supply apparatus for use with appliances, and particularly for use with temperature probes and the like.

SUMMARY OF THE INVENTION

The present invention generally comprises a detachable power supply apparatus for use with an appliance. The apparatus includes a mounting panel which can be attached, for example, to the appliance's sidewall or handle, or to the rear end of a temperature probe or the like. The mounting panel includes a ferrous contact plate attached to an outer surface thereof. A power supply device includes a socket plug with a magnet subassembly attached at or near an outer surface thereof. The plug may be removably coupled to the mounting panel by positioning the plug outer surface adjacent the mounting panel's contact plate. The magnet subassembly is designed to allow the plug to withstand a predetermined or preselected pulling force and a predetermined or preselected shearing or lateral force.

OBJECTS AND ADVANTAGES OF THE INVENTION

The principal objects and advantages of the present invention include: providing an improved detachable power supply apparatus; providing such an apparatus which can be readily attached to and detached from an electric appliance or a temperature probe; providing such an apparatus which allows the temperature probe to maintain intimate contact with the appliance to accurately and reliably control the appliance's temperature; providing such an apparatus with a power supply plug which can be magnetically coupled to the probe or appliance; providing such an apparatus which increases safe operation of the appliance by allowing the plug to be detached from the probe by the application of a predetermined or preselected lateral or shear force; providing such an apparatus which requires a predetermined or preselected pulling or tensile force to separate the power supply device from the temperature probe; providing such an apparatus that can be varied to accommodate a variety of appliance input power requirements; providing such an apparatus which meets or exceeds UL STANDARDS and applicable federal, state, and local regulations; providing such an apparatus which allows the temperature probes and appliances to meet or exceed UL STANDARDS and applicable federal, state, and local regulations; and providing such an apparatus which is particularly well-suited to its intended purpose.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is an exploded and fragmentary perspective view of a detachable power supply cord removably attached to a temperature control device which in turn is removably attached to an appliance.

FIG. 2 is an exploded, enlarged and fragmentary top plan view of the temperature control device of FIG. 1 with a top thereof removed, and a top sectional view of an electrical receptacle plug of the power supply cord with a top thereof removed.

FIG. 10 is an exploded and fragmentary perspective view of a fifth alternative embodiment of the electrical receptacle removably attached to a third alternative embodiment of the temperature control device which is in turn removably attached to the appliance.

FIG. 11 is a fragmentary top plan view of the temperature control device of FIG. 10 with the top thereof removed.

FIG. 12 is a fragmentary, exploded, rear sectional view of the detachable electrical receptacle the temperature control device taken generally along line 8—8 of FIG. 10.

DETAILED DESCRIPTION OF THE INVENTION

General Considerations and Structures

Figure 4:
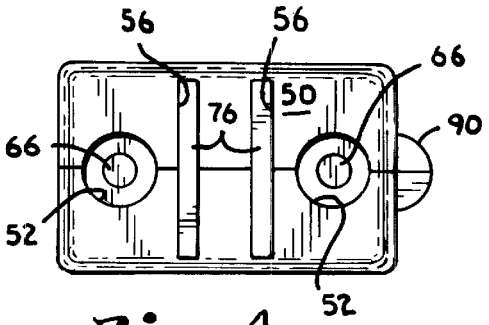
FIG. 4 is an enlarged elevational view of an outer face of the electrical receptacle plug.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Although the present invention as shown in the embodiment in FIGS. 1 and 2 includes a temperature probe and an electrical appliance, as discussed below it is foreseen that the present invention can be used in a variety of applications involving electrical appliances, with or without temperature probes, where it would be advantageous to provide a quick-disconnect power supply apparatus.

Referring to the drawings, the reference numeral 1 refers to a detachable power supply apparatus embodying the present invention. The apparatus 1 is used in connection with an electrical appliance 2 and includes a power supply device or cord 4 and a temperature control device 5. The temperature control device 5 is adapted to be connected to a power input connector 6 on the appliance 2. The power input connector 6 includes power supply prongs 7 and a probe receiver 8. The temperature control device 5 includes a supportive housing or casing 9, and a male temperature probe 10 extending outward from a front end of the casing 9.

As used herein and with reference to FIG. 2, the front of the temperature control device 5 and the power supply cord 4 are on the left side of the drawing for each item as oriented in FIG. 2. Similarly the rear of the temperature control device 5 and the power supply cord 4 are on the right side of the drawing for each item as oriented in FIG. 2. In other words, the rear of the temperature control device 5 generally comprises the side of the temperature control device 5 positioned furthest away from the appliance 2 when connected thereto.

Further, as will be noted, headings have been included in the detailed description to make it easy and convenient to locate and refer to certain parts of the detailed description. These headings are not intended to limit or restrict the detailed description, but are intended to be used as a convenient reference for certain structures, components, features, and functions of the invention, particularly so that it is unnecessary to repeat details of alternative embodiments that are the same as those of the first embodiment described.

Temperature Control Device

The housing 9 of the temperature control device 5 includes top and bottom panels 11 and 12, joined together by any convenient manner such as screws (not shown). As shown in FIG. 2, a pair of conductive female receivers 14 which form an output power supply are located within the housing 9 at a front portion thereof. The female receivers 14 are adapted to receive the power supply prongs 7 to electrically connect the temperature control device 5 to the power input connector 6 on the appliance 2. When the temperature control device 5 is connected to the power input connector 6, the male temperature probe 10 extends into the probe receiver 8. A bimetallic thermostat 18 is secured within the housing 9, and cooperates with the temperature probe 10 to regulate the appliance's 2 working temperature. As shown in FIG. 1, a thermostat control dial 20 located on the top of the housing 9 allows a user to adjust the temperature of the appliance 2 upward or downward. The temperature control device 5 is removably secured to the appliance 2 to permit total immersion washing of the appliance 2 without damaging the temperature control device 5.

Plug Connection or Mounting Panel of Temperature Control Device

A rectangular opening or receptacle 22 is formed in a rear wall 23 of the casing or housing 9. As shown in FIGS. 1 and 2, a generally rectangular, plug connection panel or mounting panel 24 is secured in and extends across the opening 22 in the rear wall 23 of the casing 9. The plug connection or mounting panel 24 is positioned rearward of the temperature control device dial 20 and on a side of the dial 20 opposite the probe 10.

Figure 5:
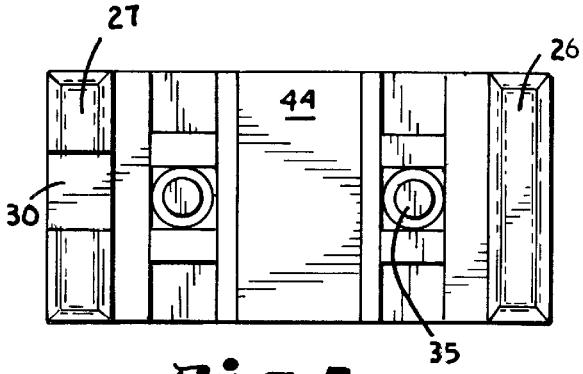
FIG. 5 is an enlarged elevational view of an outer face of the plug connection or mounting panel.
Figure 3:
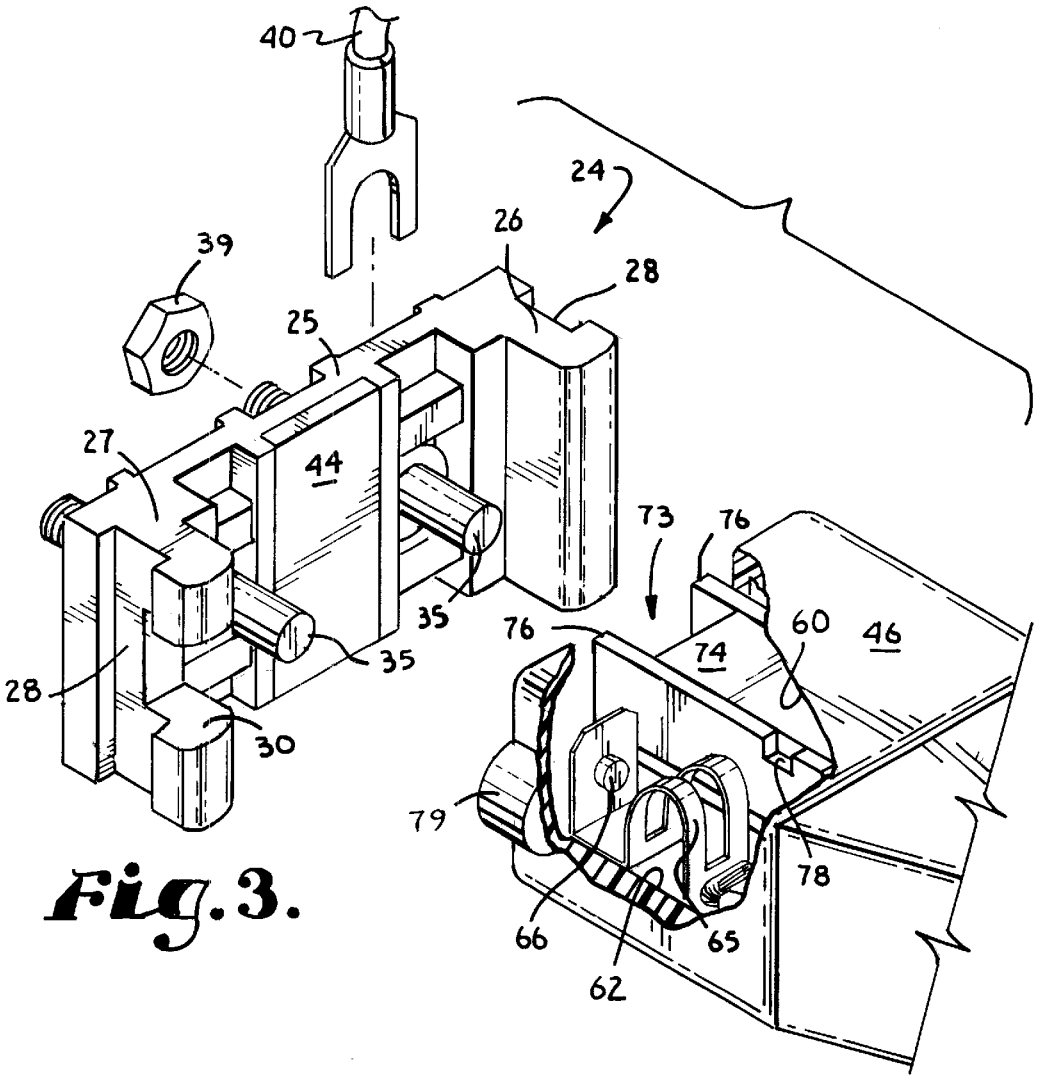
FIG. 3 is an enlarged, exploded, fragmentary perspective view of a plug connection or mounting panel and the electrical receptacle plug of the power supply cord with portions broken away to show internal details.

As shown in FIGS. 3 and 5, the plug connection or mounting panel 24 includes a central wall 25 with a pair of sidewalls 26 and 27 formed on opposite ends of the central wall 25 and generally extending rearward therefrom. Vertically extending grooves 28 are formed in an outer surface of each sidewall 26 and 27. The grooves 28 are spaced slightly rearward of the central wall 25. When the housing 9 is assembled, the plug connection or mounting panel 24 is positioned between the top and bottom panels 11 and 12 such that the edges of the rear wall 23 of the housing extend into the grooves 28 in the plug connection or mounting panel side walls 26 and 27 to hold the plug connection panel 24 in place. The location of the grooves 28 in the sidewalls 26 and 27 spaces the plug connection panel central wall 25 inward relative to a rear edge of the housing 9 such that the plug connection panel central wall 25 is recessed in the housing 9. As shown in FIG. 3, a semi-circular notch 30, the purpose of which is discussed below, is formed in sidewall 27.

As shown in FIGS. 3 and 5, a pair of conductive pins or prongs 35 extend through the central wall 25 of the plug connection or mounting panel 24 and are secured via nuts 39. As shown in FIG. 2, the pins 35 are connected by conductive wires 40 to the output power supply female receivers 14. Conductive wire 42 also supplies power to the probe 10.

As shown in FIGS. 3 and 5, a ferrous attachment plate 44 is attached to a rear or outer surface of the central wall 25 of the mounting panel 24 intermediate pins 35. The outer surface of the contact plate 44 is generally rectangular, and presents a relatively large surface area which is recessed with respect to outer ends of the pins 35.

Electrical Receptacle of Power Supply Cord

As shown in FIG. 1, the power supply cord 4 includes a female electrical receptacle 46 at one end and a plug or male electrical connector 47 at an opposite end. As shown in FIG. 4, a face or front end 50 of the receptacle 46 includes a pair of circular holes 52 and a pair of elongate slits 56 extending therethrough. Referring to FIGS. 2 and 3, a central chamber 60, and a pair of side channels 62 are formed within the receptacle 46.

As best seen in FIGS. 2 and 3, conductive contact springs 65, each having a conductive contact 66 formed on a front end thereof are secured within the side channels 62 in the electrical receptacle 46. The contact springs 65 are electrically connected to polarized wires 72 of the power supply cord 4. The contacts 66 are centrally aligned with the holes 52 in the face 50 of the receptacle for engagement by the pins 35 of the plug connection panel 24.

As shown in FIGS. 2 and 3, a magnet assembly 73 comprising a block-type magnet 74 sandwiched between a pair of relatively flat, elongate, magnetically conductive plates 76 is mounted within the chamber 60. The magnet 74 magnetizes the plates 76. Each plate 76 includes a plate outer end which extends through one of the slits 56 and protrudes slightly beyond the face or front end 50 of the receptacle 46. The plates 76 are secured in place within the central chamber 60 of the electrical receptacle 46 by any suitable means. For example, and as best seen in FIG. 3, each plate 76 may have a notch 78 formed in upper and lower surfaces thereof adapted to be engaged by projections or bosses (not shown) extending into the chamber 60 to prevent the plates 76 from sliding through the slits 56. The receptacle 46 also includes a boss or key 79 protruding from a side of the receptacle 46 proximate the front end thereof.

Coupling of Power Supply Cord and Temperature Control Device

The power supply cord 4 is coupled to the temperature control device 5 by advancing the female electrical receptacle 46 over the pins 35 in the plug connection or mounting panel 24 such that the pins 35 extend into the holes 52 of the receptacle 46. To attach the receptacle 46 to the mounting panel 24, the receptacle must be oriented such that the key 90 on the electrical receptacle 46 is aligned with the notch 30 in the sidewall 27 of the mounting panel 24. When the holes 52 in the receptacle 46 are aligned with the pins 35 in the mounting panel 24, the magnet assembly 73 in the electrical receptacle 46 is aligned with the ferrous contact plate 44 of the mounting panel 24. As the electrical receptacle 46 is advanced toward the mounting panel 24 a magnetic couple is formed between the mounting panel contact plate 44 and the magnetically conductive plates 76 extending forward and outward from the electrical receptacle 46.

The orientation of the elongate plates 76 with respect to the rectangular contact plate 44 creates a magnetic coupling which can withstand a predetermined or preselected tensile force F1 and a predetermined or preselected shear force V1 to free the electrical receptacle 46 from the housing 9 (see FIG. 1 for force vectors).

The pins 35 are longer than the distance from the front face 50 of the receptacle 46 through the holes 52 to the contacts 66 on the contact springs 65 When the electrical receptacle 46 is coupled to the mounting panel 24, the pins 35 bias the contacts 66 rearward. The diameter of the holes 52 is also considerably larger than the diameter of the pins 35 and the pins 35 are not frictionally engaged within the holes 52 as with conventional plugs. Instead, the magnetic coupling described above secures the electrical receptacle 46 to the plug connection or mounting panel 24 with the desired release characteristics. The holes 52 are sized to allow the electrical receptacle 46 to pivot or rock from side to side about the pins 35 in response to a shearing or lateral force to permit uncoupling of the electrical receptacle 46 without additional frictional resistance or damage to the pins 35. The holes 52 may also be beveled to facilitate pivoting or rocking of the pins 35 within the holes 52. The inner edges of the sidewalls 26 and 27 and upper and lower inner edges of the temperature control device housing 9 along the opening 22 function as fulcrums against which the electrical receptacle 46 may pivot upon the application of a shear force to the cord 4 to facilitate release of the power supply cord 4 from the temperature control device 5.

It is foreseen that attributes of the plug magnet assembly 74 can be changed to alter magnetic forces associated therewith. For example, magnets of varying sizes, shapes and strengths, and plates of different sizes and shapes can be utilized depending on the desired application. As a further example, a single magnet could be coupled directly to the contact plate 44, without the use of any magnetically conductive plates 76 to provide increased resistance to both a shear force V1 and to a tensile force F1. (See force vectors in FIG. 1.) Other configurations of magnet(s) and/or plate(s) can be similarly employed.

It is also foreseen that the magnetic forces between the contact plate 44 and the magnet assembly 73 could be reversed. In other words, the contact plate 44 may be magnetized with the assembly 73 being ferrous. Of course, the overall function of the coupling of the plate and the assembly 73 would be the same in either case.

It will further be noted that, depending on the flexibility of the cord 4 at the location where it connects to the electrical receptacle 46, a sharp or forceful disturbance of the cord 4 will cause a shear force V2 (in either direction or a resultant direction, depending on the nature of the disturbance) or a shear force V3 (in either direction or a resultant direction depending on the nature of the disturbance) to be applied to the electrical receptacle 46 at an end 80 of the electrical receptacle 46 resulting in a raising, lowering, or tipping of the electrical receptacle 46 out of the mounting panel 24. The electrical receptacle 46 will, nevertheless, still properly and easily detach from the mounting panel 24 in response to the preselected or predetermined forces V2 or V3 and, thus, prevent the tipping or overturning of the appliance 2 or the spilling or splashing of the contents of the appliance 2. (See force vectors in FIG. 1)

It is further foreseen that the forces F1, V1, V2, and V3 may be preselected or predetermined by altering the magnet strength and placement, the alignment, dimensions, or relative distances between the plates 76, the pins 35, the holes 52, the electrical receptacle 46, the mounting panel 24, the contact plate 44, or other parts of the mounting panel 24 and/or the electrical receptacle 46

Effect of Orientation and Alignment of Mounting Panel, Receptacle, and Cord on Detachment of Electrical Receptacle The force necessary to detach the magnetic coupling of the electrical receptacle 46 from the mounting panel 24 depends on how the receptacle 46 and the mounting panel 24 are shaped and oriented with respect to the cord 4, the appliance 2, the surface on which the appliance 2 is placed (which is assumed to be generally horizontal), and the temperature control device 5.

If the cord 4 is subjected to an accidental detachment force or disturbance along its length, it is most likely that such force will be transmitted to and first felt at the end 80 of the receptacle 46. In a typical accidental disturbance of the cord 4, such forces are likely to be parallel to the surface on which the appliance 2 is placed. This might occur, for example, if a person or pet accidentally bumped or hooked the cord 4, or if some other object is accidentally forced into contact with the cord 4. It is also possible that a person or object could disturb the cord 4 vertically if the cord 4 was accidentally pulled upward or if the cord 4 was suspended above the counter surface on which the appliance 2 was being used (or suspended above the floor if the cord 4 spanned two counters) and something fell on the cord 4, or the cord 4 was forced upward.

In the typical accidental disturbance of the cord 4 described above, the disturbance is likely to pull on and straighten the relatively flexible cord 4 and be transmitted to and first "felt" at the end 80 of the relatively rigid receptacle 46. In the embodiment of the receptacle 46 shown in FIG. 1, a substantial portion of such disturbing force will be transmitted through the relatively rigid electrical receptacle 46 perpendicular to (and away from) the contact plate 44 (and the face 50 of the electrical receptacle 46, the magnetically conductive plates 76 of which protrude slightly beyond the front of face 50 and are magnetically coupled to the contact plate 44 of the mounting panel 24).

Testing has shown that the receptacle 46 is easiest to detach if the detachment or disturbing (pulling) force that is typically first applied or felt near the end 80 of the electrical receptacle 46 either (a) is transmitted to or toward the face 50 of the receptacle 46 (and thus to the attachment or contact plate 44 of the mounting panel 24) in such a way that the resultant transmitted force in the area of the face 50 is not perpendicular to the face 50 or the contact plate 44; or (b) is first applied to, or felt at, the electrical receptacle 46 in such a way that the receptacle rotates or tips out of the mounting panel 24. In either case, (a) or (b), the receptacle 46 is more easily detached (or requires less force to detach) because, the receptacle 46 is rotated or "peeled" from the contact plate 44 of the mounting panel 24 in a relatively gradual way (or in advancing stages) which requires less force to detach than separating the entire receptacle 46 all at once. For example, upon rotation or tipping of the electrical receptacle 46 in one direction, the conductive plates 76 of the receptacle 46 may be pulled out of contact with the contact plate 44 of the mounting panel 24 one at a time—i.e., one of the conductive plates 76 detaches from the contact plate 44 before the other—requiring less force than separating both of the conductive plates 76 from the contact plate 44 at the same time. Alternatively, if the electrical receptacle 46 is rotated or tipped out of the mounting panel in another direction, the conductive plates 76 will be pulled off of the contact plate 44 in stages (or relatively gradually) from one end of the conductive plates 76 to the other, again requiring less detachment or pulling force that separating the entirety of both plates at one time.

For the same reasons, the receptacle 46 is most difficult to detach the if the resultant detachment force is applied or felt perpendicularly to the contact plate 44 in the area of the face 50, because there is little or no tipping or rotation of the electrical receptacle 46, and the conductive plates 76 must be disengaged from the contact plate 44 all at once, which requires more force.

Accordingly, the orientation, angles, shape and alignment of the various components of the apparatus 1, particularly the mounting plate 24, the cord 4, the electrical receptacle 46, and the end 80 of the electrical receptacle 46, have a significant affect on the amount of force necessary to detach the electrical receptacle 46 from its magnetic coupling with the mounting plate 24. Thus, in preselecting or predetermining the pulling or shear force at which the receptacle 46 is to detach from the mounting panel 24, it is desirable to also determine or select the orientation, angles, and alignment of the various components of the apparatus 1.

The mounting panel 24 and the receptacle 46 may be installed and/or shaped such that a detachment or disturbing force first applied or felt near the end 80 of the receptacle 46 would not likely be perpendicular to the contact plate 44 of the mounting panel (or the face 50 of the electrical receptacle 46), or, alternatively, would cause the electrical receptacle 46 to rotate, tip, or peel out of the mounting panel 24, thus making it easier for such a force to detach the receptacle 46 from the mounting panel 24. In other words, the mounting panel 24 and the receptacle 46 may be installed and/or shaped so as to reduce the magnitude of the force necessary to detach the receptacle 46 from the mounting panel 24 by maximizing the probability (a) that the disturbing force will cause the electrical receptacle 46 to be tipped, peeled, or rotated out of the mounting panel 24, or (b) that the disturbing force will be applied or felt in the area of the face 50 in such a way that the disturbing force is not perpendicular to the contact plate 44 of the mounting panel 24.

One way to provide that a typical detachment force is transmitted at a non-perpendicular angle to the face 50 of the receptacle 46 in the embodiment shown in FIGS. 1 and 2 is to shape the mounting panel 24 such that the central wall 25 of the mounting panel 24 is wider at the top than at the bottom, thus causing the contact plate 44 to be oriented and angled upward with respect to the rear wall 23 of the housing 9. Alternatively, the central wall 25 of the mounting panel 24 could be made wider at the top than at the bottom such that the contact plate 44 is oriented and angled downward with respect to the rear wall 23 of the housing 9 of the temperature control device 5.

Similarly, in the embodiment shown in FIGS. 1 and 2, the power input connector 6 or the temperature control device 5 could be formed and shaped so that they were oriented at an angle with respect to the appliance 2 or the surface on which the appliance 2 is placed such that, although the mounting panel 24 is installed substantially parallel to and coterminous with the rear wall 23 of the housing 9, the mounting panel 24 is oriented at an angle with respect to the surface on which the appliance 2 is placed when it is in use.

Of course, it is also possible to adjust the shape and orientation of the temperature control device 5 or the receptacle 46 such that the disturbance or detachment force will likely rotate the electrical receptacle 46 out of the mounting panel, or will likely be applied at an angle that is not perpendicular to the contact plate 44 of the mounting panel 24 or the face 50 of the electrical receptacle 46. Below are specific examples of preferred embodiments of the electrical receptacle 46 and the temperature control device 5 that are installed, aligned, and shaped so as to reduce the magnitude of the force necessary to detach the electrical receptacle 46 from its magnetic coupling with the mounting panel 24.

FIGS. 6, 7, 8, and 9 show four alternative embodiments of the apparatus 1. In each of these embodiments temperature control device 5 is constructed in essentially the same manner and contains the same parts, components, attachments, and other attributes as the temperature control device 5 described above under the heading "Temperature Control Device," and the electrical receptacle 46 is constructed in essentially the same manner and contains the same parts, components, attachments, and other attributes as the electrical receptacle 46 described above under the heading "Electrical Receptacle of Power Supply Cord." (See, also, FIGS. 2 and 3.) However, in each of the embodiments shown in FIGS. 6, 7, 8, and 9, the shape and orientation of the electrical receptacle 46 or the temperature control device 5 have been changed to increase the likelihood that an accidental disturbing or detachment force will be applied to the electrical receptacle 46 in a way that makes it easier for the electrical receptacle 46 to detach from the mounting panel 24.

Figure 6:
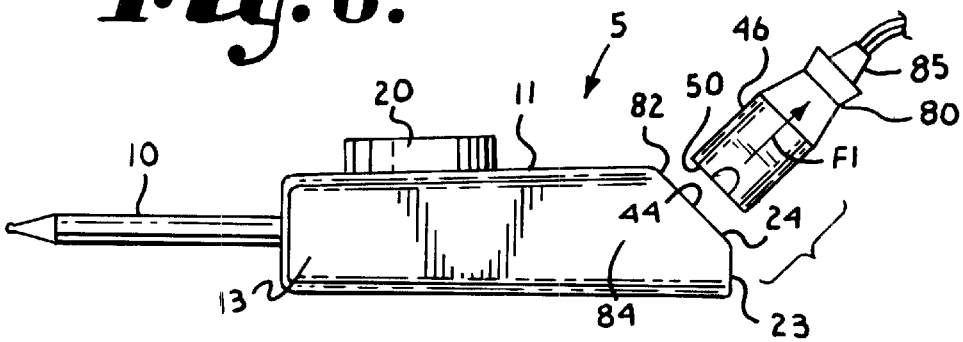
FIG. 6 is an exploded side view of the electrical receptacle of the detachable power supply apparatus removably attached to a second alternative embodiment of the temperature control device.
Figure 7:
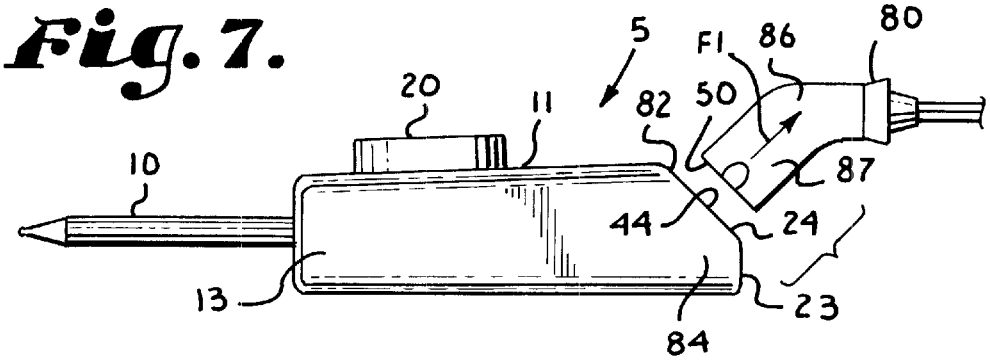
FIG. 7 is an exploded side view of the second alternative embodiment of the temperature control device of the detachable power supply apparatus removably attached to a second alternative embodiment of the electrical receptacle.
Figure 8:
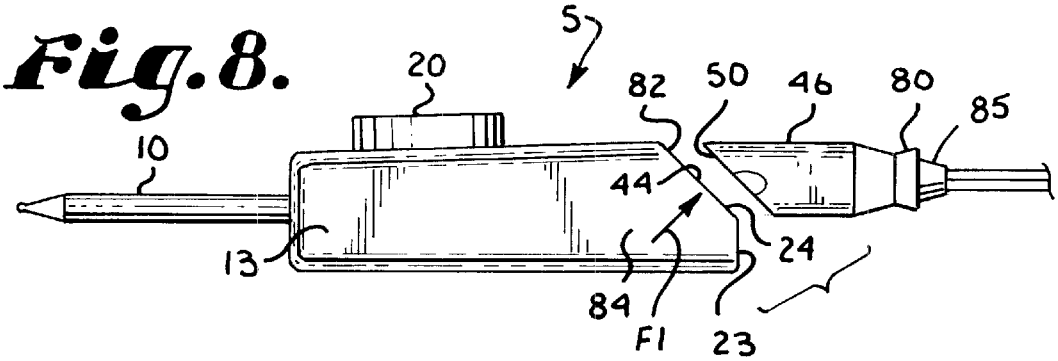
FIG. 8 is an exploded side view of the second alternative embodiment of the temperature control device of the detachable power supply apparatus attached to a third alternative embodiment of the electrical receptacle.

In the embodiments shown in FIGS. 6, 7, and 8, the mounting panel 24 is installed in an angled section 82 of a rear portion 84 of the temperature control device 5.

In the embodiment shown in FIG. 6, the electrical receptacle 46 has a cord connection 85 exiting the end 80 of electrical receptacle 46 generally perpendicular to the contact plate 44 of the mounting panel 24 and to the face 50 of the electrical receptacle 46. It will be seen from this arrangement that a disturbing or detachment force applied via the cord 4 to the cord connection 85 will cause the receptacle 44 to tip or rotate off its magnetic coupling with mounting panel 24 (thus reducing the force necessary to detach the receptacle 46) in nearly all cases, the only exception being the unlikely event that the resultant disturbing force is angled upward with respect to the horizontal surface on which the appliance 2 is being used sufficiently so that the resultant disturbing or detachment force is perpendicular to the plate 44 of the mounting panel 24.

In the embodiment shown in FIG. 7, the electrical receptacle 46 is formed such that a portion 86 of the electrical receptacle 46 near the end 80 is angled with respect to a portion 87 of the receptacle 46 near the face 50. In this arrangement, a disturbing or detachment force applied to the end 80 of the receptacle 46 via the cord 4 will tip or rotate the receptacle 46 off of its magnetic coupling with the mounting panel 24 (thus reducing the force necessary to detach the receptacle 46) in all cases.

In the embodiment shown in FIG. 8, the face 50 of the electrical receptacle is angled with respect to the portion 87 of the receptacle 46 near the face 50. A_disturbing or detachment force applied to the end 80 of the receptacle 46 the via the cord 4 will somewhat tip or rotate the receptacle 46, thus somewhat reducing the force necessary to detach the receptacle 46. An arrangement such as shown in FIG. 8 would be useful with smaller (or reduced strength) magnets and would present a desirable, streamlined appearance to the apparatus 1.

Figure 9:
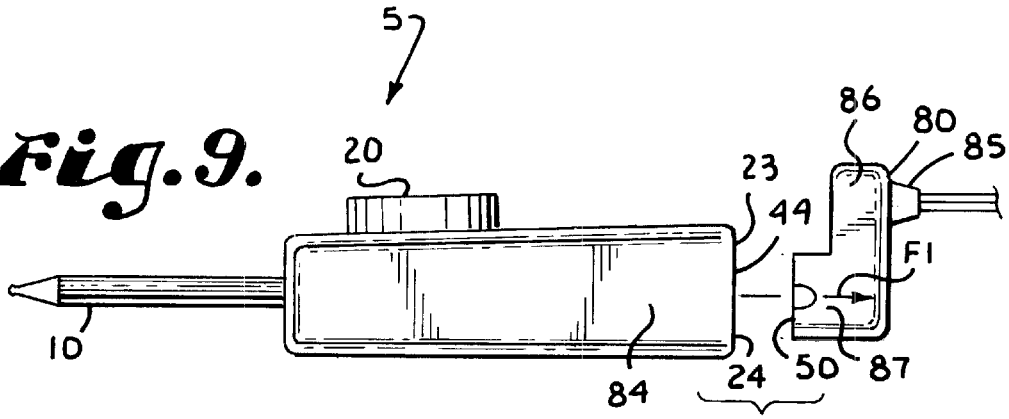
FIG. 9 is an exploded side view of the second alternative embodiment of the temperature control device of the detachable power supply apparatus attached to a fourth alternative embodiment of the electrical receptacle.

In the embodiment shown in FIG. 9, the mounting panel 24 is installed in the rear wall 23 of the housing 9 of the temperature control device 5 in the same manner as is shown in FIGS. 1 and 2. The receptacle 46, however, is L shaped such that the portion 86 of the electrical receptacle 46 near the end 80 is at a right (90 degree) angle with respect to the portion 87 of the receptacle 46 near the face 50 of the electrical receptacle 46, and the cord connection 85 exits the end 80 of the electrical receptacle 46 generally perpendicularly to the portion 86 and to the attachment or contact plate 44 of the mounting panel 24. It will be noted that, in the embodiment shown in FIG. 9, the cord connection 85 is above and at a right angle to the face 50 of the electrical receptacle 46. Accordingly, when a disturbing or detachment force is applied to the end 80 of the receptacle 46 via the cord 4, the receptacle will tip or rotate the receptacle 46 off of its magnetic coupling with the mounting panel 24 in all cases.

In addition, it will be noted that, in each of the embodiments shown in FIGS. 6, 7, 8, and 9, the resultant disturbing force in the area of the face 50 is not along force vector F1, i.e., is not perpendicular to the contact plate 44.

Further, it will be noted that the arrangements, orientations, and locations of the electrical receptacle 46 and the mounting panel 24 shown in FIGS. 1, 2, 6, 7, 8, and 9 have varying affects on the overall size and convenience of the use of the temperature control 5. In the embodiments shown in FIGS. 1, 2, and 8, the position and orientation of the electrical receptacle 46 is such that the receptacle 46 does not extend into the area where the user's hand would be placed to adjust the control dial 20. In the embodiments shown in FIGS. 6, 7, and 9, the receptacle 46 does extend somewhat into the area where the user's hand would be placed to adjust the control dial 20, but the length of the apparatus 1 is reduced, making it easier to store when not in use and less expensive to build.

Referring again to FIGS. 6 through 8 the mounting panel 24 is generally recessed in the rear portion 84 of the temperature control device 5 and extends at an angle between generally horizontal and vertical alignment. The pins or electrical terminals are secured to the mounting panel 24 in a manner similar to that shown in FIGS. 1–3 and extend generally perpendicular to a mount surface of the mounting panel 24. As noted previously the holes or terminal receiving bores 52 in receptacle 46 have a diameter which is sufficiently larger than an outer diameter of the pins or terminals 35 to permit the receptacle 46, which is relatively rigid, to tip, rock or pivot away from the pins 35 without interference from the pins 35. Referring to FIG. 7 it is seen that the electrical cord is connected to the receptacle 46 such that a first end of the cord generally does not extend in planar alignment with a plane extending between the axis of the terminal receiving bores or holes 52 in the receptacle 46. Stated another way, the face of the receptacle 46 to which the electrical cord is attached does not extend in parallel alignment with the outer face 50 of the receptacle.

Top Mount Alternative Embodiment

General Structure

In FIGS. 10, 11, and 12, the numeral 101 refers to an alternative top-mounted embodiment of the detachable power supply apparatus embodying the present invention. The apparatus 101 is used in connection with an electrical appliance 102 that includes a power supply device or cord 104 and a temperature control device 105 that is adapted to be connected to a power input connector 106 on the appliance 102, which power input connector 106 includes power supply prongs 107 and a probe receiver 108. The additional considerations and structural details applicable to the apparatus 101 are the same as those described above with respect to apparatus 1 under the heading "General Considerations and Structures."

Top Mount Temperature Control Device

As shown in FIGS. 10 and 11, the temperature control device 105 includes a housing 109 and a male temperature probe 110 extending outward from a front end of the housing 109. The housing 109 of temperature control device 105 includes top and bottom panels 111 and 112, respectively. A thermostat control dial 120 is located on top of the housing 109 of the temperature control device 105. The temperature control device 105 may be constructed in essentially the same manner and contain the same parts, components, attachments, relationships, positions, and other attributes as the temperature control device 5 of the apparatus 1 described above under the heading "Temperature Control Device," except that, in the temperature control device 105, a rectangular opening or receptacle 122 is formed in the top panel 111 of the housing 109 instead of in a rear wall or panel of the housing 109.

Top Mount Plug Connection or Mounting Panel

As shown in FIGS. 10 and 11, a generally rectangular, plug connection panel or mounting panel 124 is secured in and extends across the opening 122 in the top panel 111. The mounting panel 124 of the control device 105 is positioned rearward of the control dial 120 and on a side of the control dial 120 opposite the probe 110 in a position similar to the mounting panel 24 of control device 5 of apparatus 1, except that, in the control device 105 of the apparatus 101, the mounting panel 124 is secured within the opening 122 in the top panel or wall of the control device 105 instead of a rear wall thereof as is the case of the mounting panel 24 in the control device 5.

In all other respects, the plug connection panel or mounting panel 124 of temperature control device 105 may be constructed in essentially the same manner and contain the same parts, components, attachments, relationships, positions, and other attributes as the mounting panel 24 of temperature control device 5 of the apparatus 1 described above under the heading "Plug Connection Panel of Temperature Control Device." (See, also, FIGS. 3, 4, and 5.)

It is, of course, understood that, although FIGS. 10 and 11 show the rectangular mounting panel 124 to be placed or oriented in the temperature control device 105 so that the long side of the mounting panel 124 is perpendicular to the longitudinal axis or the temperature control device 105 (and perpendicular to the longitudinal axis of probe 110), the mounting panel 124 could be placed or oriented in the temperature control device at any angle or orientation with respect to the longitudinal axis of the temperature control device 105.

Electrical Receptacle of Top Mount Power Supply Cord

As shown in FIGS. 10 and 12, the power supply cord 104 of apparatus 101 includes a female electrical receptacle 146 and a plug or male electrical receptor 147. The female electrical receptacle 146 may be constructed in essentially the same manner and contain the same parts, components, attachments, relationships, positions, and other attributes as the receptacle 46 of the power supply cord 4 of the apparatus 1 described above under the heading "Electrical Receptacle of Power Supply Cord." (See, also, FIGS. 2 and 3.) In the embodiment shown in FIGS. 10 and 12, however, the cord 104 is connected to a side 179 of the electrical receptacle 146 near an end 180 of the receptacle 146.

It is foreseen that the mounting panel 124 and the electrical receptacle 146 could be made in different shapes, such as, for example, round or square instead of rectangular, without any substantial affect on the invention disclosed herein, providing only that the electrical receptacle 146 and the mounting panel 124 would have cooperative shapes permitting the electrical receptacle 146 to be properly mounted on the mounting panel 124. (The same, of course, is true for the receptacle 46 and the mounting panel 24 of the apparatus 1.)

Coupling of Top Mount Power Supply Cord and Temperature Control Device

The coupling of the electrical receptacle 146 of the power supply cord 104 to the mounting panel 124 of temperature control device 105 is accomplished in the same way and subject to the same considerations, attachments, sizings, positions, attributes, and alternatives as is described above with respect to the apparatus 1 under the heading "Coupling of Power Supply Cord and Temperature Control Device".

As in the case of the coupling of the electrical receptacle 46 to the mounting panel 24 in the apparatus 1, the coupling of the electrical receptacle 146 of the power supply cord 104 to the mounting panel 105 of apparatus 101 is a magnetic coupling which can withstand a predetermined or preselected tensile force F101 and predetermined or preselected shear forces V101 or V102 (perpendicular to V101 and F101) to free the plug 146 from the housing 9 (see FIG. 6 for force vectors).

In the case of the top mount alternative apparatus 101, it is quite likely that a sharp, forceful, or strong disturbance of the power supply cord 104 will be first transmitted to, or felt at, near the end 180 of electrical receptacle 146 as a shear forces V101 or V102, due to the vertical orientation of the electrical receptacle 146 in the mounting panel 124 and due to the attachment of the cord 104 on the side 179 of the receptacle 146. Most detachment or disturbance forces will, due to the vertical orientation or alignment of the receptacle 146 and the placement of the cord 104 on the side 179 of the receptacle 146, cause the electrical receptacle 146 to tip, rotate, or peel out of the mounting panel 124, thus reducing the disturbing force necessary to detach the receptacle 146 from the contact plate 144 of the mounting panel 124 and, ultimately, allow the receptacle 146 to detach from the temperature control device 105 without tipping the appliance 2 or spilling its contents. In addition, of course, the forces can be preselected and predetermined to provide the desired detachment force. See, for example, the various considerations and alternatives discussed above in connection with apparatus 1 under the heading "Coupling of Power Supply Cord and Temperature Control Device."

Affect of Orientation and Alignment of Mounting Panel, Receptacle, and Cord on Detachment of Electrical Receptacle in the Top Mount Apparatus.

The affect of the orientation and alignment of the mounting panel 124, the receptacle 146, and the cord 104 on the detachment of the electrical receptacle 146 from the mounting panel is subject to the same to the same considerations, attachments, sizings, positions, attributes, and alternatives as are described above with respect to the apparatus 1 under the heading "Affect of Orientation and Alignment of Mounting Panel, Receptacle, and Cord on Detachment of Electrical Receptacle" (See also FIGS. 6 through 9.)

Side Mount Alternative Embodiment

General Structure

Figure 13:
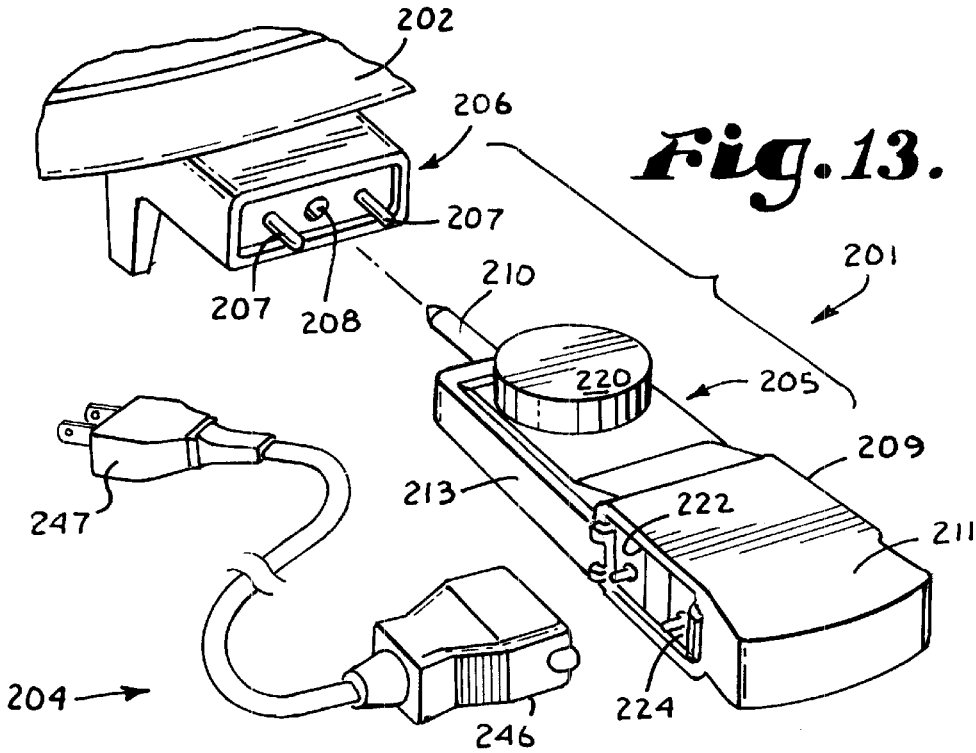
FIG. 13 is an exploded and fragmentary perspective view of the power supply cord electrical receptacle removably attached to a fourth alternative embodiment of the temperature which is in turn removably attached to the appliance.
Figure 14:
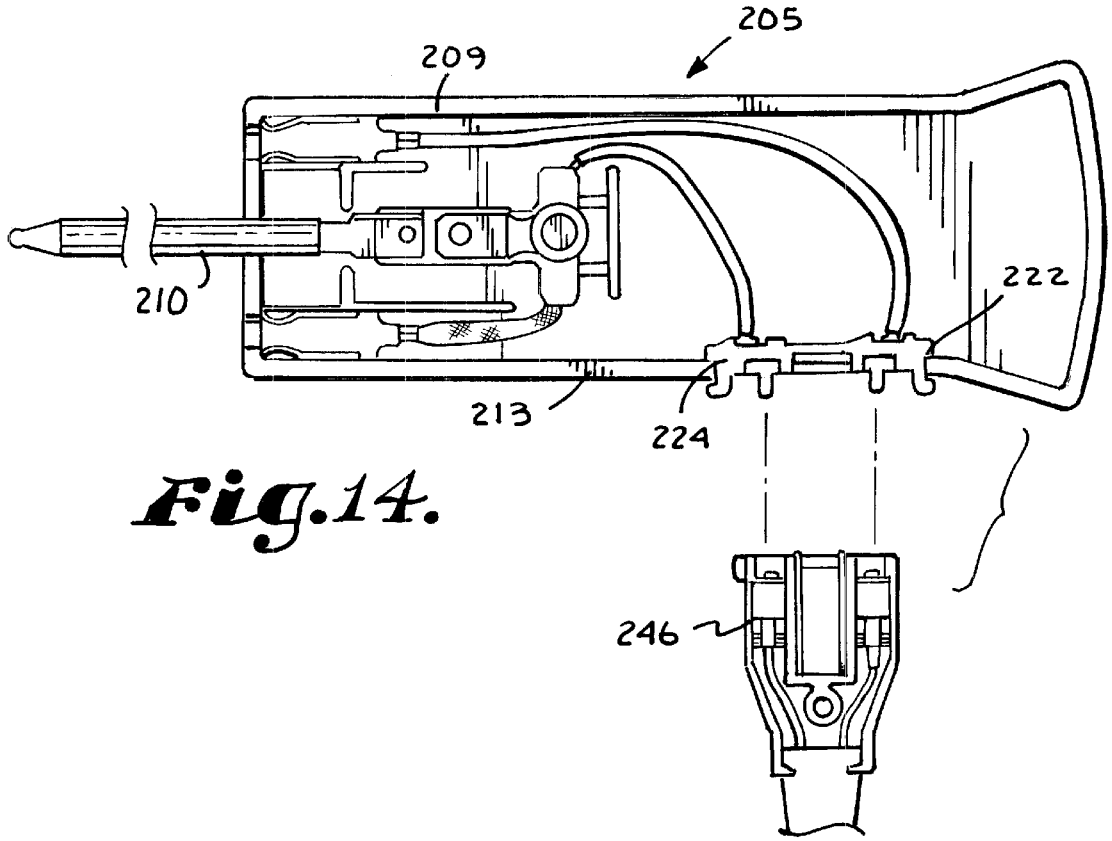
FIG. 14 is an exploded, enlarged and fragmentary top plan view of the electrical receptacle of the detachable power supply cord and the temperature control device of FIG. 13 with top portions thereof removed to show interior detail.

As shown in FIGS. 13 and 14, the numeral 201 generally refers to an alternative, side-mounted embodiment of the detachable power supply apparatus embodying the present invention. The apparatus 201 is used in connection with an electrical appliance 202 that includes a power supply device or cord 204 and a temperature control device 205 that is adapted to be connected to a power input connector 206 on the appliance 202, which power input connector 206 includes power supply prongs 207 and a probe receiver 208. The additional considerations and structural details applicable to the apparatus 201 are the same as those described above with respect to the apparatus 1 under the heading "General Considerations and Structures".

Side Mount Temperature Control Device

The temperature control device 205 includes a housing 209 and a male temperature probe 210 extending outward from a front end of the housing 209. The housing 209 of the temperature control device 205 includes a top panel 211 and a side panel 213. A thermostat control dial 222 is located on top of the housing 209 of the temperature control device 205. The temperature control device 205 may be constructed in essentially the same manner and contain the same parts, components, attachments, relationships, positions, and other attributes as the temperature control device 5 of the apparatus 1 described above under the heading "Temperature Control Device," except that, in the temperature control device 205, a rectangular opening or receptacle 222 is formed in the side wall 213 of the housing 209 instead of in the top wall 211 of the housing 209.

Side Mount Plug Connection or Mounting Panel

As shown in FIGS. 13 and 14, a generally rectangular, plug connection panel or mounting panel 224 is secured in and extends across the opening 222 in the side panel 213 of the housing 209. The mounting panel 224 of the control device 205 is positioned rearward of the control dial 220 and on a side of the control dial 220 opposite the probe 210 in a position similar to the mounting panel 24 of control device 5 of the apparatus 1, except that, in control device 205 of apparatus 201, mounting panel 224 is secured within the opening 222 in the side panel or wall 213 of the control device 205 instead of in a rear wall thereof as is the case of the mounting panel 24 in the control device 5.

In all other respects, the plug connection panel or mounting panel 224 of temperature control device 205 may be constructed in essentially the same manner and contain the same parts, components, attachments, relationships, positions, alternatives, and other attributes as the mounting panel 24 of temperature control device 5 of the apparatus 1 described above under the heading "Plug Connection Panel of Temperature Control Device" and as described above with respect to mounting panel 124 of temperature control device 105 under the heading "Top Mount Plug Connection or Mounting Panel." (See, also FIGS. 2, 3, 4, and 5.)

Electrical Receptacle of Side Mount Power Supply Cord

The power supply cord 204 of apparatus 201 includes a female electrical receptacle 246 and a plug or male electrical receptor 247. The female electrical receptacle 246 may be constructed in essentially the same manner and contain the same parts, components, attachments, relationships, positions, alternatives, and other attributes as the receptacle 46 of the power supply cord 4 of the apparatus 1 described above under the heading "Electrical Receptacle of Power Supply Cord" and as described above with respect to electrical receptacle 146 of power supply cord 104 under the heading "Electrical Receptacle of Top Mount Power Supply Cord." (See, also, FIGS. 2 and 3.)

Coupling of Side Mount Power Supply Cord and Temperature Control Device

The coupling of the electrical receptacle 246 of the power supply cord 204 to the mounting panel 224 of the temperature control device 205 is accomplished in the same way and subject to the same considerations, attachments, sizings, positions, attributes, and alternatives as are described above with respect to the apparatus 1 under the heading "Coupling of Power Supply Cord and Temperature Control Device" and as are described above with respect to the apparatus 101 under the heading "Coupling of Top Mount Power Supply Cord and Temperature Control Device."

Affect of Orientation and Alignment of Mounting Panel, Receptacle, and Cord on Detachment of Electrical Receptacle in the Side Mount Apparatus The affect of the orientation and alignment of the mounting panel 224, the receptacle 246, and the cord 204 on the detachment of the electrical receptacle 146 from the mounting panel is subject to the same to the same considerations, attachments, sizings, positions, attributes, and alternatives as are described above with respect to the apparatus 1 under the heading "Affect of Orientation and Alignment of Mounting Panel, Receptacle, and Cord on Detachment of Electrical Receptacle" (See also FIGS. 6 through 9.)

It is to be understood that while certain forms of the present invention have been illustrated and described herein, it is not to be limited to the specific forms or arrangement of parts described and shown.

What is claimed and desired to be secured by Letters Patent is as follows:

1. An electric cooking appliance with a detachable power supply comprising:

a) an electric cooking appliance;

b) a panel connected to said electric cooking appliance, said panel having a first mount surface and a pair of electrical terminals electrically coupled to said electric cooking appliance, said first mount surface extending at an angle between generally horizontal and vertical alignment when said electric cooking appliance is supported in an upright alignment and said electrical terminals extending generally perpendicular to said first mount surface;

c) a power supply cord having a receptacle secured at a first end of an electrical cord; a second mount surface formed on an outer face of said receptacle and a pair of terminal receiving bores extending into said receptacle from said outer face thereof for receiving said electrical terminals; said terminal receiving bores having a diameter which is sufficiently larger than an outer diameter of said terminals to permit said receptacle to pivot away from said terminals without interference from said terminals;

d) a magnetized member attached to one of the first mount surface of the panel or the second mount surface of the receptacle and a ferrous contact attached to the other of the first or second mount surface for removably coupling said power supply cord to said electric cooking appliance.

2. The electric cooking appliance as in claim 1 wherein said first mount surface faces upward when said electric cooking appliance is supported in an upright orientation on a horizontal surface.

3. The electric cooking appliance as in claim 2 wherein said first mount surface extends at an acute angle relative to the surface on which said electric cooking appliance is supported.

4. The electric cooking appliance as in claim 2 wherein said first mount surface extends at an angle of approximately forty five degrees relative to the surface on which said electric cooking appliance is supported.

5. An electric cooking appliance having a detachable power supply comprising:

a) an electric cooking appliance having a vertical axis passing through a geometric center of said electric cooking appliance;

b) a panel connected to said electric cooking appliance, said panel having a first mount surface and a pair of electrical terminals electrically coupled to said electric cooking appliance, said first mount surface having an upper edge and a lower edge and extending at an angle with respect to horizontal when said electric cooking appliance is supported in an upright alignment on a horizontal surface, such that said upper edge of said first mount surface is closer to said vertical axis than is said lower edge of said first mount surface;

c) a power supply cord having a receptacle secured at a first end of an electrical cord; a second mount surface formed on an outer face of said receptacle and a pair of terminal receiving bores extending into said receptacle from said outer face thereof for receiving said electrical terminals; said terminal receiving bores having a diameter which is sufficiently larger than an outer diameter of said terminals to permit said receptacle to pivot away from said terminals without interference from said terminals;

d) a magnetized member attached to one of the first mount surface of the panel or the second mount surface of the receptacle and a ferrous contact attached to the other of the first or second mount surface for removably coupling said power supply cord to said electric cooking appliance.

6. The electric cooking appliance as in claim 5 wherein said first mount surface extends at an acute angle relative to the surface on which said electric cooking appliance is supported.

7. The electric cooking appliance as in claim 5 wherein said first mount surface extends at an angle of approximately forty five degrees relative to the surface on which said electric cooking appliance is supported.

* * * * *